US007736019B2

(12) United States Patent
Shimada et al.

(10) Patent No.: US 7,736,019 B2
(45) Date of Patent: Jun. 15, 2010

(54) LIGHTING SYSTEM

(75) Inventors: Junichi Shimada, Kyoto (JP); Yoichi Kawakami, Kusatsu (JP); Motokazu Yamada, Tokushima (JP); Masaru Kato, Sagamihara (JP)

(73) Assignee: Yanchers Corporation, Kyoto (JP)

( * ) Notice: Subject to any disclaimer, the term of this patent is extended or adjusted under 35 U.S.C. 154(b) by 824 days.

(21) Appl. No.: 11/544,706

(22) Filed: Oct. 10, 2006

(65) Prior Publication Data

US 2008/0084693 A1 Apr. 10, 2008

(51) Int. Cl.
*F21V 5/00* (2006.01)

(52) U.S. Cl. ..... 362/244; 362/231; 362/249.06; 362/249.14

(58) Field of Classification Search ..... 362/249.01, 362/249.02, 249.06, 249.14, 237, 240, 244, 362/245, 247, 248, 147, 404, 231, 293; 315/15, 315/19, 24

See application file for complete search history.

(56) References Cited

U.S. PATENT DOCUMENTS 5,680,231 A * 10/1997 Grinberg et al. ..... 359/15
6,707,435 B1 * 3/2004 Merlato et al. ..... 345/39
6,929,384 B2 * 8/2005 Watanabe et al. ..... 362/235
7,300,177 B2 * 11/2007 Conner ..... 362/244
2007/0030676 A1 * 2/2007 Ichihara ..... 362/244

FOREIGN PATENT DOCUMENTS

| | | |
|---|---|---|
| JP | A 09-069651 | 3/1997 |
| JP | A 10-154833 | 6/1998 |
| JP | A-2000-21209 | 1/2000 |
| JP | B2 3118798 | 10/2000 |
| JP | A 2002-049326 | 2/2002 |
| JP | A-2002-304903 | 10/2002 |
| JP | A-2004-281352 | 10/2004 |

* cited by examiner

*Primary Examiner*—Thomas M Sember
(74) *Attorney, Agent, or Firm*—Oliff & Berridge, PLC

(57) ABSTRACT

The lighting system according to the present invention includes an electrical wiring substrate in which a connector to a power source is formed, a plurality of LED chips mounted in a predetermined array pattern on the electrical wiring substrate, a deflection lens array disposed in proximity to the LED chips between the LED chip and the predetermined illumination region and a housing for receiving the electrical wiring substrate and the deflection lens array. A plurality of deflection lenses are integrally molded in the deflection lens array to lead lights from the LED chips to the predetermined illumination region in a state where the lights from the LED chips are superposed with each other. The lights emitted from the LED chips are collected in a state where they all are superposed in a common, single illumination region through the deflection lenses.

10 Claims, 8 Drawing Sheets

LIGHTING SYSTEM

BACKGROUND OF THE INVENTION

1. Field of the Invention

The present invention relates to a compact lighting system having a high illumination and a uniform luminous distribution characteristic.

2. Description of the Related Art

A light emitting diode (LED) has an advantage that it is compact and the power consumption is small and therefore, the lifetime is more than ten times that of a fluorescent light. Incorporation of a condenser lens into this LED allows approximately 90% of the emitted lights to be projected ahead without an additional, specific reflector. This type of lighting system can project light having extremely strong directivity and high luminance. There is developed a large-sized LED (power LED) a light emitting area of which is larger than conventional and which has extremely high luminance. There are studies on an application of such a power LED in various fields as a compact light source for illumination in low consumption power instead of a conventional incandescent lamp or a fluorescent light.

Techniques with respect to LEDs applicable to such a light source for illumination are proposed by Japanese Patent Application Laid-open No. 9-069561 (1997), Japanese Patent Application Laid-open No. 2002-049326, Japanese Patent No. 3118798 and so on. Japanese Patent Application Laid-open No. 9-069651 (1997) discloses a semiconductor light emitting module capable of increasing reliability and having no variation in characteristics by avoiding characteristic degradation and characteristic defect due to bonding of a lead thin line by using a selected light emitting diode device. Japanese Patent Application Laid-open No. 2002-049326 discloses a planar semiconductor light emitting device in which optical elements for collimation having an array corresponding to an array of LED chips are arranged as a micro lens array. By the planar semiconductor light emitting device, a large part of lights emitted by individual LED chips can be projected within an extremely narrow range. Japanese Patent No. 3118798 discloses a semiconductor light emitting module in which outer lenses are located as opposed respectively to light emitting diodes arranged by predetermined intervals, thereby making it possible to illuminate a larger area.

The power LED having a light emitting area larger than that of the conventional LED has a relatively large variation in light emitting luminance for each product. Therefore, in order to produce a product having a light emitting luminance within a predetermined tolerance, the manufacturing yield is only several dozens of percentages according to the current technology. Accordingly, in a case where this power LED is used as a light source for illumination requiring a uniform luminous distribution characteristic, it leads to an extremely high cost due to the low manufacturing yield as described above.

In the semiconductor light emitting module disclosed in Japanese Patent Application Laid-open No. 9-069651 (1997), selection of light emitting diode device is made for avoiding variations in characteristic. Therefore, as a result of basically eliminating use of a light emitting diode device exceeding a predetermined tolerance, the manufacturing yield of light emitting diodes deteriorates in the same way as in the case of the power LED, leading to an increase of a manufacturing cost of the semiconductor light emitting module.

The planar semiconductor light emitting device disclosed in Japanese Patent Application Laid-open No. 2002-049326 locates optical elements for collimation having an array corresponding to an array of the LED chips, as a micro lens array.

Therefore, there occurs illumination unevenness in response to the variation in light emitting luminance of the individual LED chip. Yet since a LED chip array having an area in accordance with the illumination region is required, in a case of illuminating a large region in an uniform luminous distribution characteristic, a large amount of LED chips corresponding thereto are required to be used. Accordingly, this light emitting device is not nearly practical in terms of costs.

In the semiconductor light emitting module disclosed in Japanese Patent No. 3118798, the respective light emitting diodes and outer lenses are designed to separately illuminate only a part of the entire illumination region. This is apparent because the light emitting diodes and the outer lenses are arranged coaxially. As a result, in the same way as in the case of Japanese Patent Application Laid-open No. 2002-049326, the variation in the light emitting luminance of each light emitting diode leads directly to illumination unevenness in the illumination region, so that the uniform luminous distribution characteristic, i.e., the uniform illumination distribution can not be basically obtained. In addition, in a case of selecting the light emitting diodes for avoiding this problem, the manufacturing cost increases.

SUMMARY OF THE INVENTION

A lighting system according to the present invention comprises a wiring substrate in which a connecting portion to a power source is formed, a plurality of semiconductor light emitting devices mounted in a predetermined array pattern on the wiring substrate, a light deflection optical element disposed in proximity to the semiconductor light emitting devices between the semiconductor light emitting device and a predetermined spatial region to lead lights emitted from the semiconductor light emitting devices to the predetermined spatial region in a state where the lights are superposed with each other, and a housing for receiving the light deflection optical element and the wiring substrate therein.

In FIG. 1 showing the principle of the present invention, lights L emitted from respective semiconductor light emitting devices 1 are led in a state where they are superposed in a predetermined spatial region Z through a light deflection optical element 2. In other words, the lights emitted from the respective semiconductor light emitting devices 1 are condensed in a state where they are all superposed in a single predetermined spatial region Z.

According to the lighting system of the present invention, since all lights emitted from the semiconductor light emitting devices are led to the same location in such a manner as to be mutually superposed, the lighting system can illuminate a predetermined spatial region in an extremely high luminance. In addition, even if luminance unevenness occurs in each semi conductor light emitting device itself, since all lights are led to the same location, the influence of each semiconductor light emitting device itself does not occur at all. Therefore, a plurality of semiconductor light emitting devices having a lot of variations in luminance can be used without selection thereof, and particularly an effective use of a power LED having a low manufacturing yield is possible. Even if one of the plurality of the semiconductor light emitting devices does not emit light due to any cause, the illumination in the illumination region is just lowered by the corresponding amount. Accordingly, this lighting system of the present invention is extremely convenient in a state where the lighting system can not be replaced.

Furthermore, since a plurality of semiconductor light emitting devices are mounted in a wiring substrate, it is possible to modularize the plurality of the semiconductor light emitting devices mounted in the wiring substrate. Thereby, the number of the modules is increased/decreased in accordance with illumination required in the illumination region, easily changing the illumination of the lighting system.

The present invention does not require to precisely superpose all of the light beams emitted from the individual semiconductor light emitting devices 1 in a predetermined spatial region Z. It is naturally possible to intentionally form a region in which light beams emitted from the individual semiconductor light emitting devices 1 are not superposed on each other at a boundary portion of the spatial region Z by shifting a relative position between the semiconductor light emitting device 1 and the light deflection optical element 2 or a relative position between this lighting system and the predetermined spatial region Z. The present invention also encompasses the above-described aspect.

In the lighting system according to the present invention, at least two kinds of the semiconductor light emitting devices having different color rendering properties may be mounted on the wiring substrate in such a manner as to be mixed in a predetermined ratio. In this case, it is possible to obtain illumination light having desired color rendering properties. Therefore, for example, two kinds of semiconductor light emitting devices are simply prepared, each color temperature having 4800K and 7200K and by changing a combination of the number of the two to be used, it is possible to produce an illumination light having substantially any color temperature between 4800K and 7200K. Accordingly, it is not required to use a semiconductor light emitting device having a specific color rendering properties.

A filter through which the light emitted from at least one of the semiconductor light emitting devices passes may be disposed between the semiconductor light emitting device and the predetermined spatial region or between the light deflection optical element and the predetermined spatial region. In this case, the filter may be a color filter for correcting a color rendering property, a ND filter which has a distribution to the light transmissivity, or a light diffuser for diffusing light. This allows a color temperature of the illumination region to be modified subtly or an illumination in the illumination region to be uniformly corrected. It is also effective to mount a filter on a housing so as to seal the inside of the housing. In particular, when this filter is employed as a light diffuser, it is preferable to form an optical element for diffusing light on an internal face of a filter opposed to the light deflection optical element. This can prevent a dust or the like from being deposited on the optical element, making it possible to facilitate to clean a surface of the filter.

The semiconductor light emitting device may be a LED into which a condenser lens is incorporated integrally, especially a white LED, and optical axes of the LEDs may be in parallel with each other. In this case, a general white light as an illumination light can be obtained and besides, a mounting job of the LED to the wiring substrate can be easily and quickly done.

A predetermined spatial region of the present invention may be made of a two-dimensional plane intersecting with or in parallel to an optical axis of the LED or a three-dimensional plane. In a case where the predetermined spatial region is made of the three-dimensional plane, a hologram is suitable for a light deflection optical element. In this case, even if the predetermined spatial region is made of the three-dimensional plane, a uniform illumination can be certainly made. Additionally, the distance form the semiconductor light emitting device to the hologram is set as the shortest to provide a more compact lighting system.

The light deflection optical element may include a plurality of plano-convex lenses corresponding to the respective semiconductor light emitting devices, the plano-convex lens may have a flat optical surface facing toward the semiconductor light emitting device and a convex optical surface facing toward the predetermined spatial region, and all the flat optical surfaces of the individual plano-convex lenses may be on a common plane. In this case, it is possible to prevent occurrence of a shade or a luminescent line due to a boundary part of neighboring plano-convex lenses. In addition, this allows a further high density package of the LEDs. Furthermore, it is possible to reduce a distance from the semiconductor light emitting device to a flat optical surface of each plano-convex lens. By a combination of these advantages, the lighting system can be made smaller in size.

A convex optical surface of each plano-convex lens as described above is shaped to be in an asymmetric, aspheric surface, thus inclining an optical axis of these plano-convex lens in the direction of the predetermined spatial region. Alternatively, the optical axis of the LED is set in parallel to the optical axis of the plano-convex lens corresponding thereto and an array pattern of the plano-convex lenses is set to be similar to an array pattern of the semiconductor light emitting devices, thereby setting an interval between the neighboring plano-convex lenses shorter than an interval between the neighboring semiconductor light emitting devices.

The plurality of the plano-convex lenses may be integrally molded in an array. In this case, positioning of the plano-convex lens to each semiconductor light emitting device is extremely easily made, thus easily manufacturing a lighting system.

In the present invention, two or more predetermined spatial regions may be formed so as to be distant from each other.

Further features of the present invention will become apparent from the following description of exemplary embodiments (with reference to the attached drawings).

DESCRIPTION OF THE EMBODIMENTS

A lighting system in an embodiment of the present invention will be described in detail with reference to FIGS. 2 to 6. The present invention is, however, not limited to the embodiment, but can include all alternations and modifications included in the concept of the present invention described in claims. Accordingly, it is apparent that the present invention can be applied to any other technology within the spirit thereof.

Figure 1:
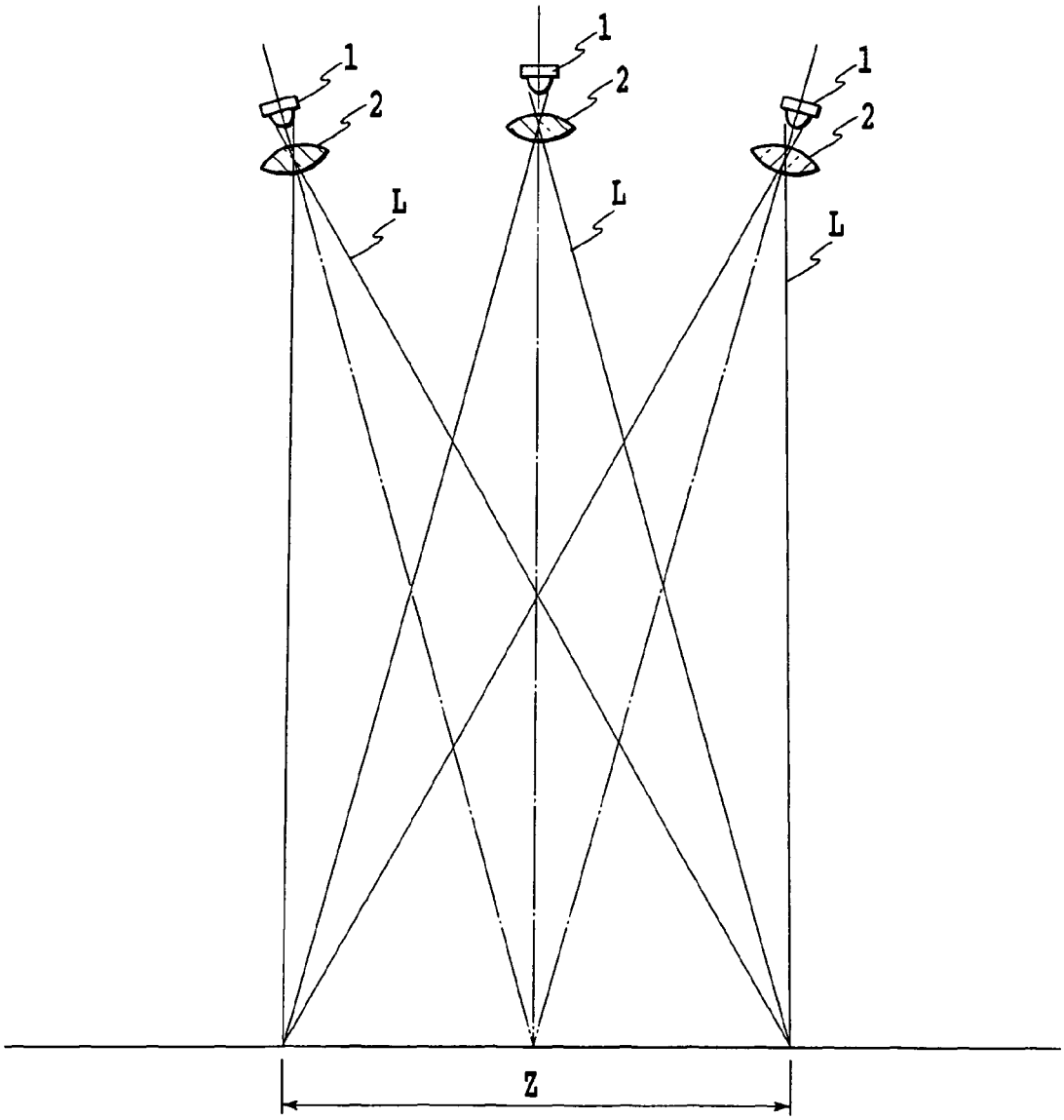
FIG. 1 is a schematic diagram of the present invention.
Figure 2:
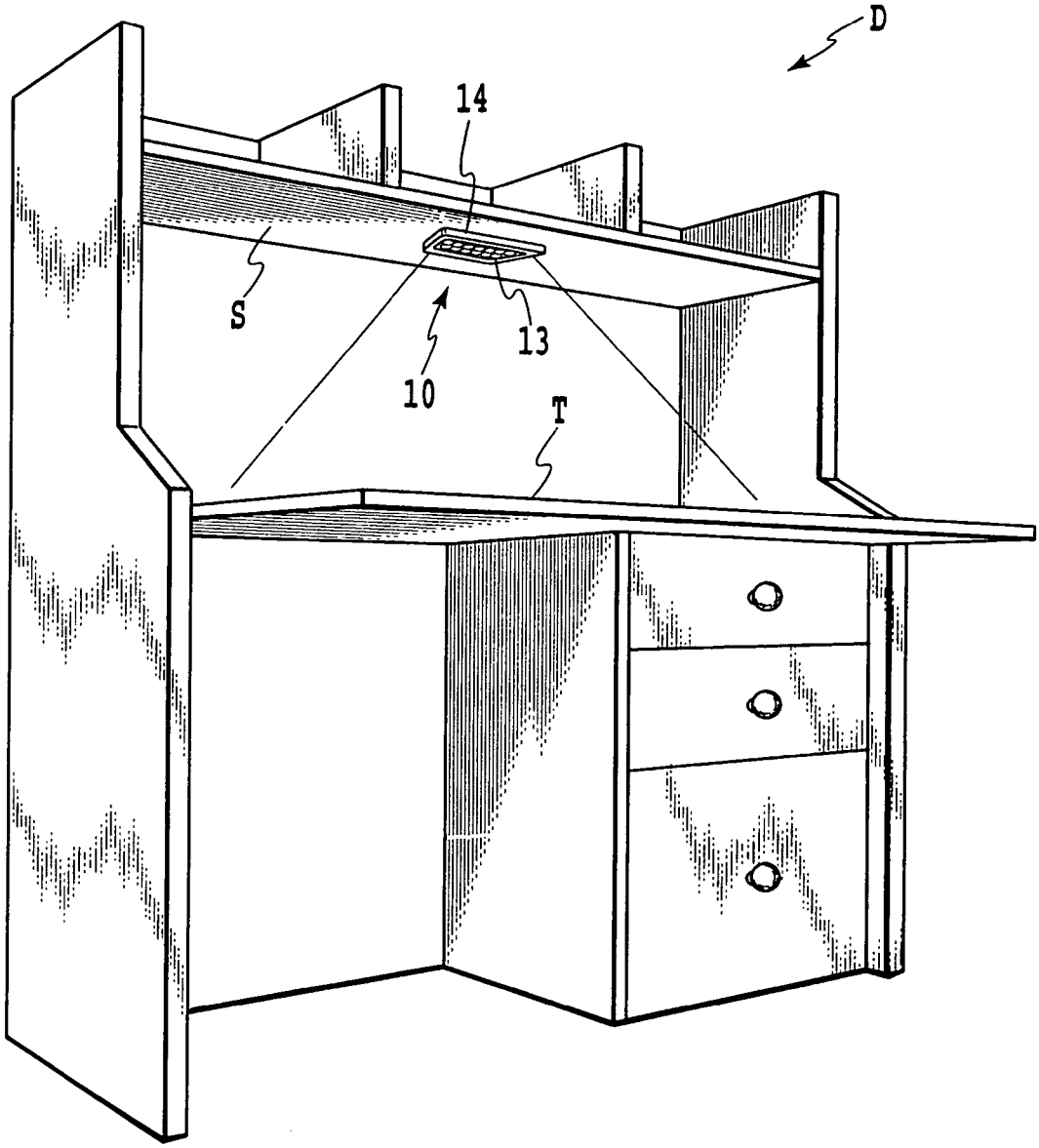
FIG. 2 is a three-dimensional projected view showing an outside appearance in an embodiment where a lighting system of the present invention is applied to a reading lamp incorporated into a writing desk.
Figure 3:
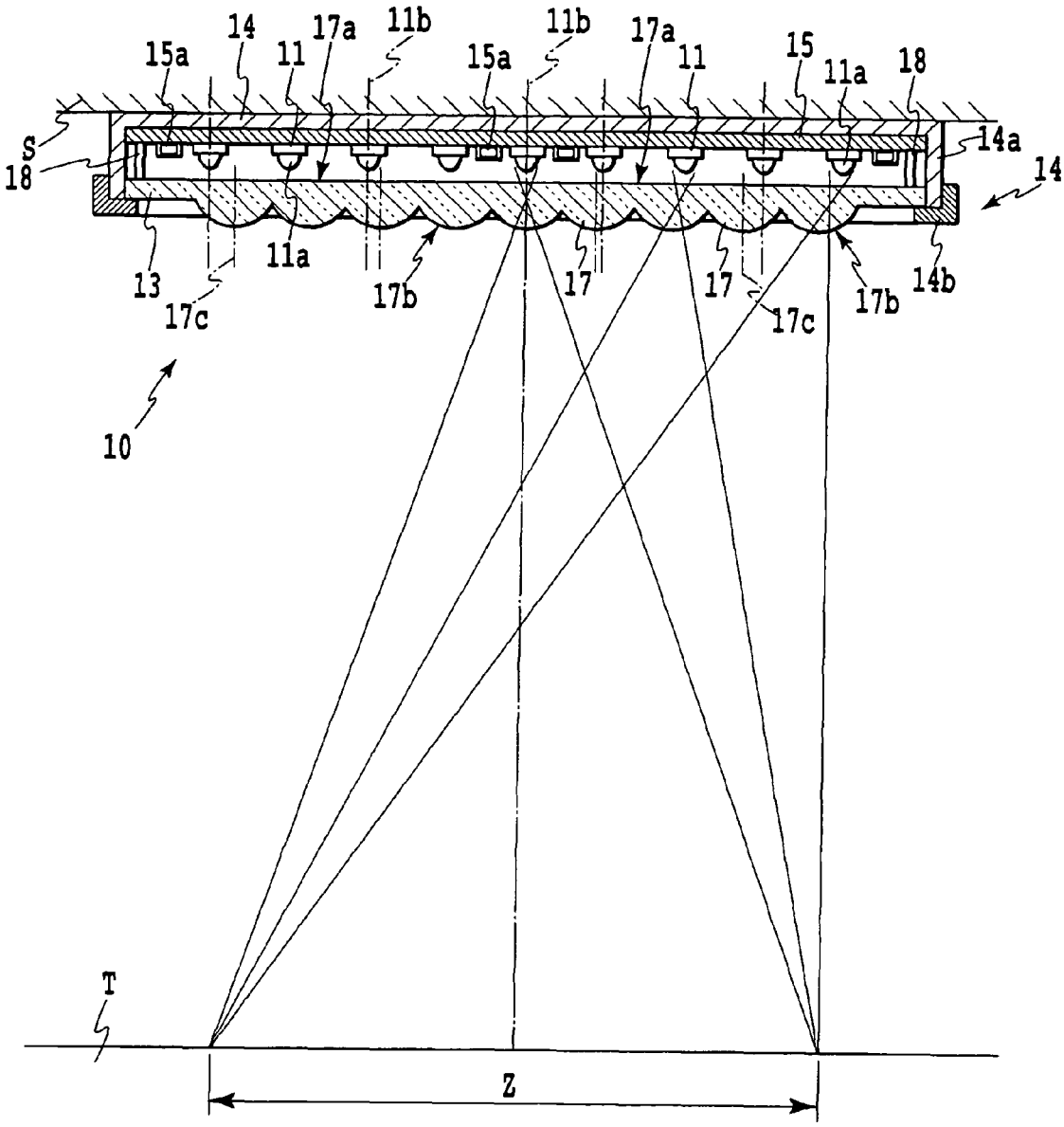
FIG. 3 is a cross-sectional view of a main part of the embodiment shown in FIG. 2.
Figure 4:
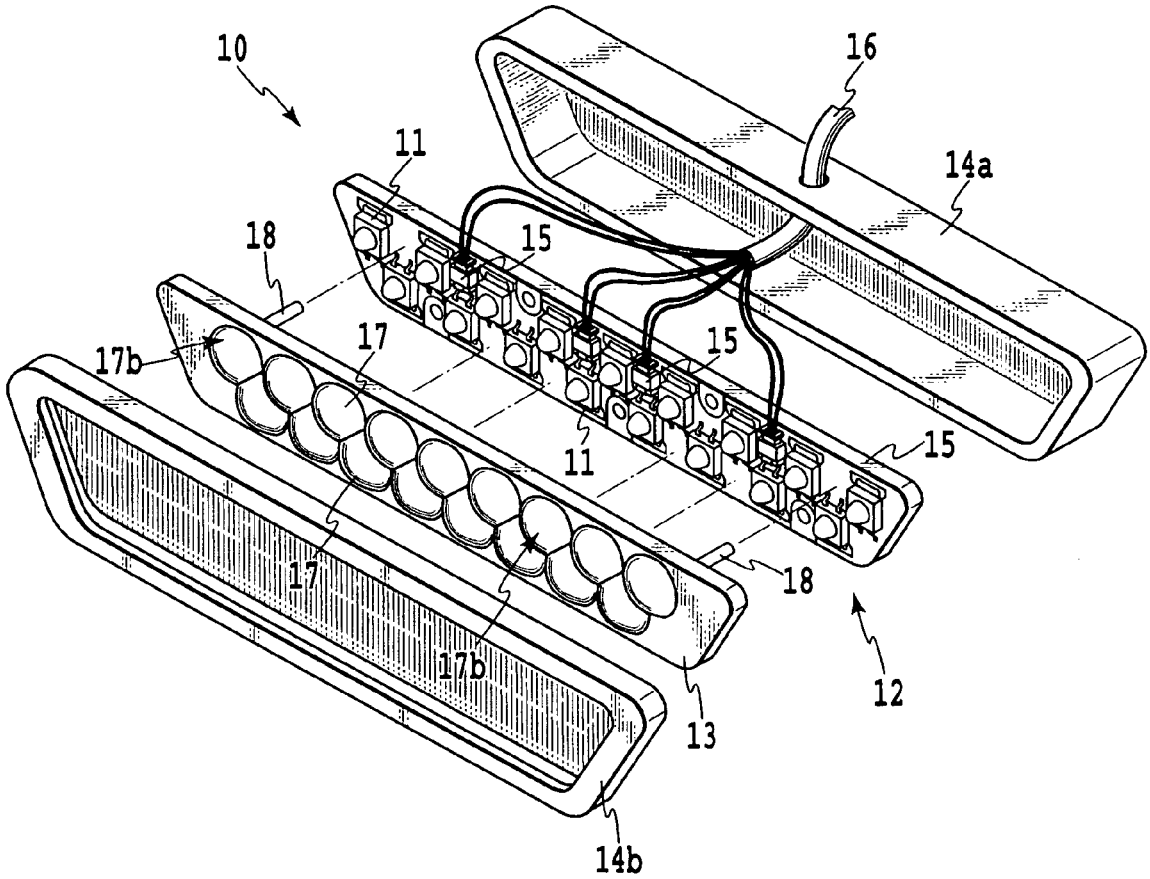
FIG. 4 is a three-dimensional, exploded, projected view showing an outside appearance of the embodiment in FIG. 2.

FIG. 2 shows an outside appearance in an embodiment where the present invention is applied to a reading lamp incorporated into a study desk, FIG. 3 shows a cross-sectional structure thereof and FIG. 4 shows an exploded state of an outside appearance of a main part thereof. A reading lamp 10 in the embodiment is mounted on the back side of the shelf board S of a writing desk D and designed to illuminate on a top board T. The reading lamp 10 has a main part composed of a LED module into which a plurality of LED chips 11 are incorporated in a predetermined array pattern, a deflection lens array 13 for irradiating lights from the LED module 12 toward a surface of the top board T, and a housing 14 for receiving the LED module 12 and the deflection lens array 13 in a positioned state. The deflection lens array 13 is located ahead of the LED module 12 in proximity thereto.

The LED module 12 includes a plurality of LED chips 11, an electrical wiring substrate 15 on which the LED chips 11 are mounted by predetermined intervals, a cable for supplying power to each LED chip 11 and the like. Condenser lenses 11*a* are incorporated integrally into the respective LED chips 11 so that optical axes of the condenser lenses 11*a* are in parallel to each other. The cable 16 is connected to connectors 15*a* disposed in the electrical wiring substrate 15. The LED chip 11 used as the semiconductor light emitting device of the present invention is made of a white power LED and for radiating heat, the base of the electrical wiring substrate 15, the housing 14 or the like is formed of aluminum having a relatively high thermal conductivity. In the embodiment, 17 pieces of the LED chips 11 are arrayed in two rows on the electrical wiring substrate 15 and mounted in a state where they are shifted by a half pitch with each other along the direction of each row. However, an array state or the like of the LED chips 11 to the electrical wiring substrate 15 can be changed as needed in accordance with a characteristic required in the lighting system.

When a special illumination effect is not intended for an object to be illuminated, it is general to use a white LED having color rendering properties close to sunlight as in the case of the embodiment. In a case where desired color rendering properties can not be obtained only with a single kind of white LED, at least two kinds of white LEDs having different color rendering properties are combined and subtraction mixing of the colors is used, whereby an illumination light adjusted to desired color rendering properties can be obtained. For example, in a case of obtaining an illumination light having a color temperature of 5600K, a white LED having a color temperature of 7200K and a white LED having a color temperature of 4800K, which are commercially available, are adopted in a ratio of 1 to 2 to obtain an illumination light having a color temperature close to about 5600K. That is, according to this method, it is not required to manufacture the white LED having a color temperature of 5600K and it is possible to effectively use commercially available white LEDs.

Since the modulation of color temperatures on the chromaticity coordinates is depicted in a curve, not linearly, a linear interpolation of the color temperatures as described above is possible in a limited region (for example, a range of 4800K to 7200K). Accordingly, in a case of using a LED having a color temperature out of this range, it is required to adjust a ratio of a LED combination based upon a color temperature curve.

The deflection lens array 13 in this embodiment located at a predetermined distance from and in proximity to the LED module 12 is a product molded of optically transparent polymethylmethacrylate (PMMA). The deflection lens array 13 includes deflection lenses 17 (plano-convex lenses in the embodiment) set in a reduced array pattern similar and corresponding to the respective LED chips 11. Each deflection lens 17 includes a flat optical surface 17*a* facing toward the LED chip 11, and a convex optical surface 17*b* facing an illumination region Z, i.e., to the top board T. An optical axis 17*c* of the deflection lens 17 is set in parallel to an optical axis 11*b* of the condenser lens 11*a* of the LED chip 11. The respective deflection lenses 17 are set in a reduced array pattern corresponding and similar to the LED chips 11. Therefore, an interval between the adjacent deflection lenses 17 is set to be shorter than that between the adjacent condenser lenses 11*a*. The optical axis 17*c* of the deflection lens 17 is offset to the central side of the illumination region Z from the optical axis 11*b* of the corresponding condenser lens 11*a*. An offset amount of each deflection lens 17 is set depending on a focus distance thereof or a relative position between the corresponding LED chip 11 and the illumination region Z.

In this embodiment, the flat optical surfaces 17*a* directed toward the LED chip 11 are all positioned on a common plane so as to be perpendicular to the optical axis 11*b* of the condenser lens 11*a*. This causes easy manufacture of a mold for injection-molding the deflection lens array 13 and further, eliminates an eclipse occurring due to the shoulder in the boundary part between the adjacent deflection lenses 17, making it possible to prevent occurrence of a dark line or a bright line in the illumination region Z. As a result, it is possible to produce a further high density mounting of the LED chips 11. And yet, the distance between the condenser lens 11*a* and the deflection lens array 13 is reduced to the minimum, and with this, it is possible to produce a more compact lighting system.

The function required for the deflection lens 17 is to guide a light flux emitted from the condenser lens 11*a* of each LED chip 11 to a single illumination region Z in a as uniform illumination distribution as possible. In other words, each deflection lens 17 is designed so that an image of an end face of the condenser lens 11*a* is formed in a single illumination region Z, i.e., on the surface of the top board T in an enlarged state in the embodiment. For this purpose, the offset amount of each deflection lens 17 is set based upon a relative position between the corresponding LED chip 11 and the illumination region Z. Further, for making an illumination distribution of lights in the illumination region Z be uniform, it is effective to mold the convex optical surface 17*b* of each deflection lens 17, together with the condenser lens 11*a* incorporated into the LED chip 11, to any proper aspheric surface configuration, not limited to a spherical surface.

When the optical axis 17*c* of the deflection lens 17 is offset toward the central side of the illumination region Z from the optical axis 11*b* of the corresponding condenser lens 11*a*, the illumination distribution of lights reaching the illumination region Z becomes uneven along the offset direction of the deflection lens 17. Additionally, the illumination at one end along the offset direction (the side of the optical axis 11*b* of the corresponding condenser lens 11*a*) relatively increases. However, the offset direction of each of the optical axes 17*c* of all deflection lens 17 is set to be symmetric to the center of the LED module 12 and thereby, the unevenness of the illumination distribution is all cancelled out. As a result, it is possible to maintain the illumination distribution in the illumination region Z to be substantially uniform.

Thus, since the lights from the respective LED chips 11 are all condensed in the single illumination region Z, it is possible to perform illumination with extremely high illumination to the surface of the top board T. And further, even if light emitting luminance of each LED chip 11 is uneven due to the variations in the manufacture of the respective LED chips 11, the illumination unevenness occurring in the conventional lighting system can be completely eliminated. Therefore, even the LED chips 11 wasted conventionally as defectives for reasons of lack of the luminance can be used without any problem, thereby reducing largely part costs in the semiconductor light emitting device. Further, even if one LED chip 11 has not emitted light for any reason, the illumination in the illumination region Z is simply reduced by the corresponding amount, and the illumination can continue as it is as long as a specific reason does not occur.

A plurality of spacer pins 18 are formed as projected from the region except the flat optical surface 17*a* on the surface (the side of the flat optical surface 17*a*) of the deflection lens array 13 facing the LED module 12 for maintaining a predetermined clearance between the LED module 12 and the deflection lens array 13. The clearance between the LED module 12 and the deflection lens array 13 is set in accordance with a focal distance of the deflection lens 17 and a size (expansion rate of the LED chip 11) of the illumination region Z. Since a design of the deflection lens 17 is required to change in accordance with a distance between the deflection lens array 13 and the illumination region Z (surface of the top board T) or the size of the illumination region Z, a length of the spacer pin 18 is also required to change with this modification. It is important to set the clearance between the LED module 12 and the deflection lens array 13 as designed. Accordingly, it is effective that the LED module 12 and the deflection lens array 13 are integrally assembled by any fastening means in such a manner that a relative position between the LED module 12 and the deflection lens array 13 does not become misaligned by an external force.

The housing 14 includes a body portion 14*a* having a cup-shaped cross section in conformity to an outline configuration of the LED module 12 and the deflection lens array 13 and a cover portion 14*b* fitted to an open end of the body portion 14*a* and connected integrally to the body portion 14*a* by a setscrew (not shown). The deflection lens array 13 is adapted not to fall off the housing 14 by getting both end edges in the array direction in contact with the cover portion 14*b*. The deflection lens array 13 may be more securely fixed inside the housing 14 by any engagement means. The body portion 14*a* has a hole 19 firmed therein for guiding the cable 16 outside of the housing 14. The cable 16 pulled out of the hole 19 outside of the housing 14 is connected to the power supply cable (not shown) through an on/off switch or a dimmer switch (both are not shown). The LED module 12 is arranged so that the back side of the electrical wiring substrate 15 is in contact with a bottom portion 14*c* of the body portion 14*a*, thereby efficiently radiating heat onto the housing 14. The structure of the housing 14 requires only a secure fixation of the LED module 12 and the deflection lens array 13 in a state where both are respectively positioned. Therefore, it is possible to change the structure of the housing 14 as needed in consideration of easy assembly or the like.

Accordingly, when power is supplied to the LED module 12 through the cable 16, the illumination region Z on the surface of the top board T is illuminated in a uniform luminous intensity distribution characteristic. It is possible to change the configuration of the illumination region Z into a rectangular shape or an elliptic shape as needed by changing the outline configuration of each deflection lens 17.

The above embodiment describes a reading lamp 10 where the illumination region Z is substantially perpendicular to the irradiation direction of the illumination light. The present invention may be, however, applied to a lighting system where the illumination region Z is inclined to the irradiation direction of the illumination light.

Figure 5:
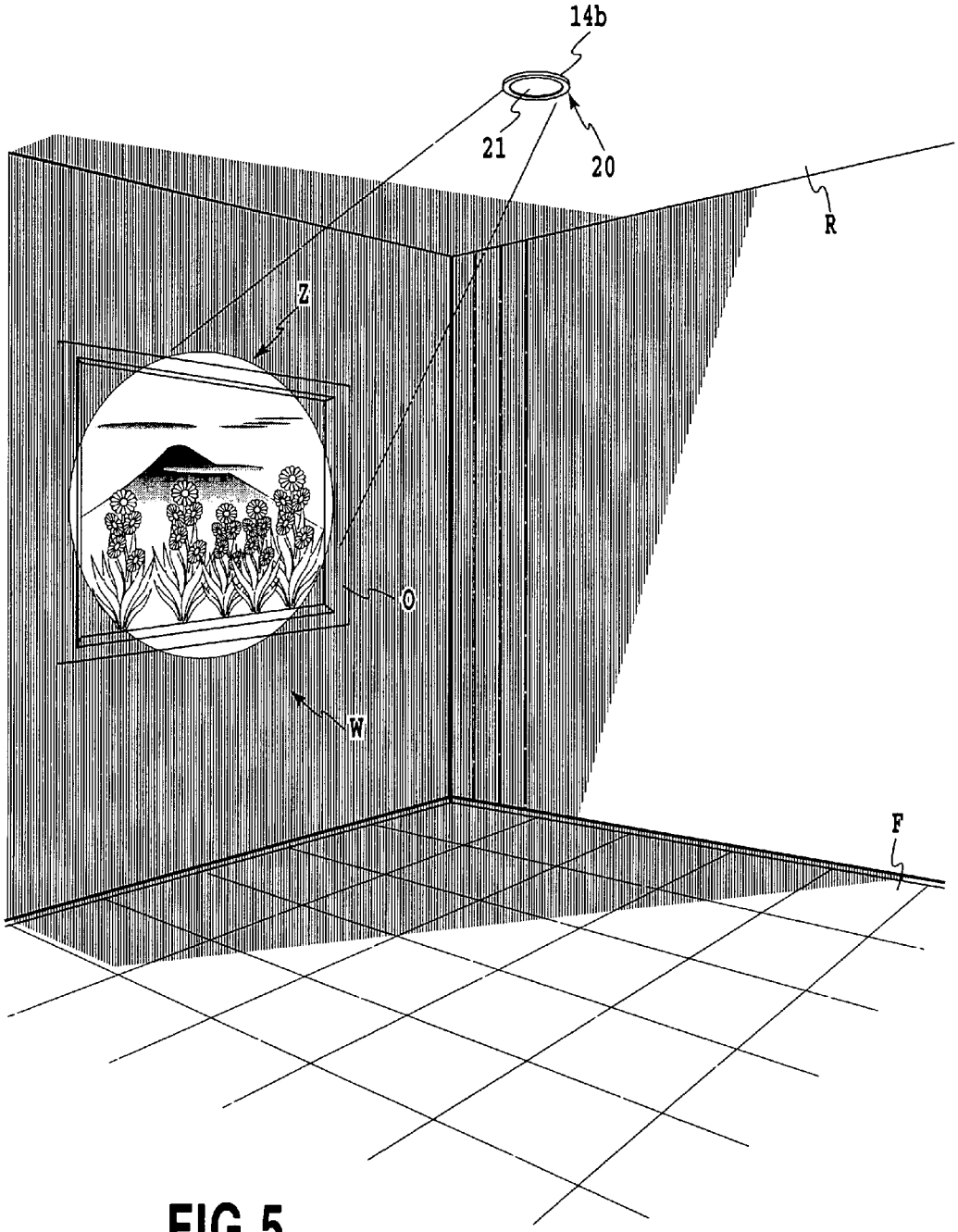
FIG. 5 is a three-dimensional projected view showing a different embodiment where a lighting system of the present invention is applied to a down spot lighting.
Figure 6:
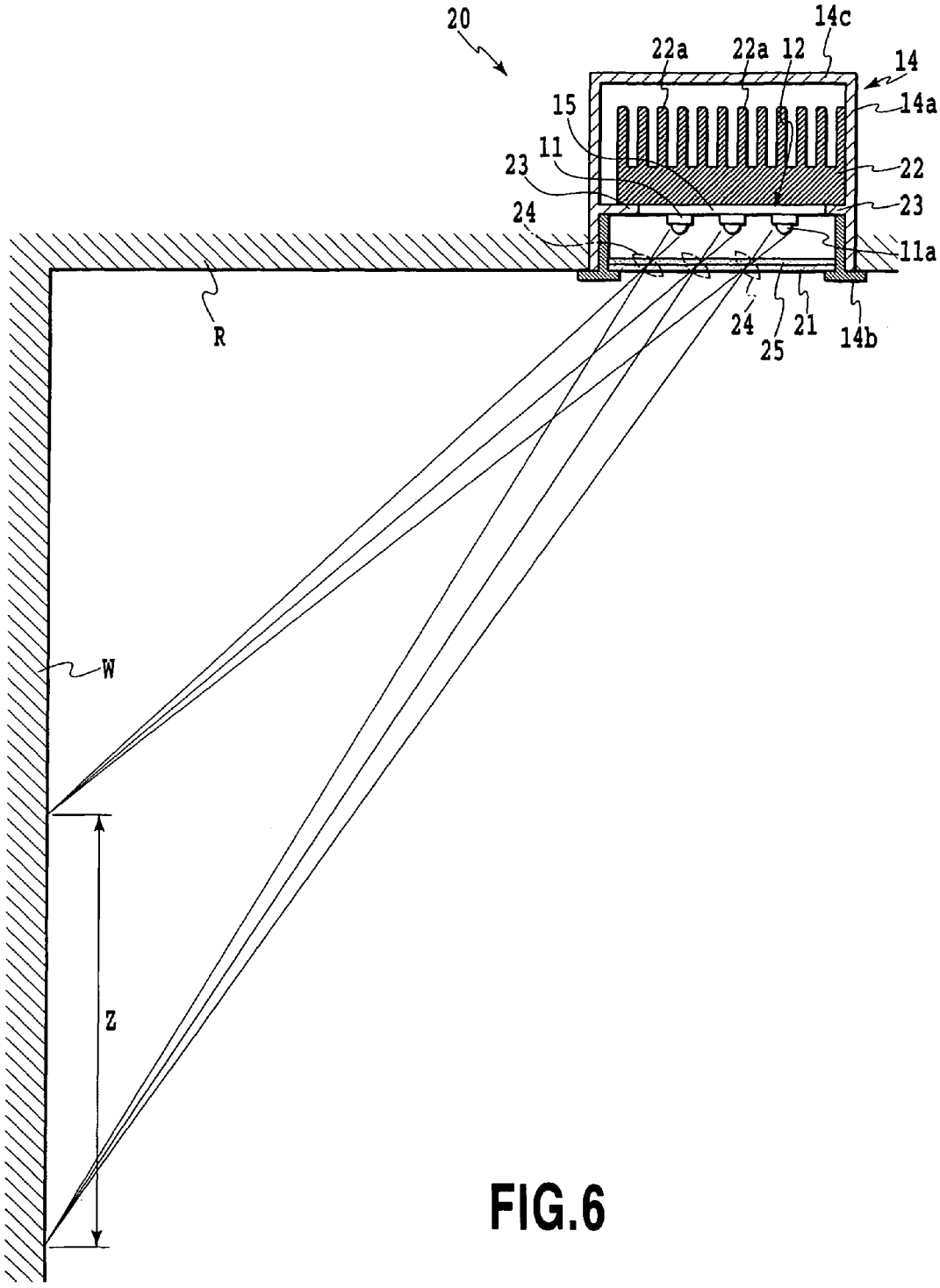
FIG. 6 is a cross-sectional view of the embodiment shown in FIG. 5.

FIG. 5 shows an outside appearance of a different embodiment where a lighting system of the present invention is applied to a down spot light for wall surface illumination and FIG. 6 shows the cross section thereof. However, components identical to those in the previous embodiment are referred to as identical numerals and the overlapped explanation is omitted. A down spot light 20 in the different embodiment is mounted into a ceiling R of the building or the like, aiming at illuminating an object O such as a painting or a photo hanging on the wall surface of the room or the corridor. The down spot light 20 has a main portion formed of a LED module 12 into which a plurality of LED chips 11 are incorporated, a hologram 21 located ahead of the LED module 12, and a cylindrical housing 14 receiving the LED module 12 and the hologram 21 in a state where both are positioned. The hologram 21 as a light deflection optical element of the present invention is to irradiate lights from the LED module 12 toward the object fixed to the wall surface W.

A heat radiation member 22 made of aluminum having radiator fins 22*a* is jointed integrally to an electrical wiring substrate 15 of the LED module 12. The heat radiation member 22 is fixed to the housing 14 through a bracket 23 disposed in an inner wall of the housing 14. In this embodiment, nine pieces of the LED chips 11 are arrayed in a grid pattern with the same pitch on the electrical wiring substrate 15. Since the illumination direction of each LED chip 11 is inclined to an optical axis 11*b* of a condenser lens 11*a* of the LED chip 11, the LED module 12 is received in an offset state in the housing 14 to prevent occurrence of an eclipse by the housing 14.

The hologram 21 in this embodiment retained inside of the body portion 14*a* of the housing 14 is a molding of optically transparent polymethylmethacrylate (PMMA). The hologram 21 functions to lead the light from each LED chip 11 to the same illumination region Z in an expansion state by using diffraction phenomena of light. In other words, the hologram 21 has the function substantially similar to a projection lens 24 as shown in a phantom line of FIG. 6 where the optical axis (not shown) is inclined toward the center of the illumination region Z.

The deflection lens array as shown in the previous embodiment may be used in place of the hologram 21 in this embodiment. In this case, the optical surfaces of the respective deflection lenses directed toward the LED chip 11 can be all positioned on the common plane in such a manner as to be substantially perpendicular to the optical axis 11*b* of the condenser lens 11*a*. Alternatively, the optical axis of the deflection lens may be inclined to the central side of the illumination region Z, but in this case, it is required to set a convex optical surface of the deflection lens directed toward the illumination region Z to an aspheric surface.

In this embodiment, a filter 25 for color temperature adjustment is disposed between the LED module 12 and the hologram 21 so as to be overlapped with the hologram 21. The filter 25 functions so that only a region to which, for example, the light from any one of the LED chips 11 is led is colored in a predetermined color and the rest of it is completely transparent with no color. This allows a color temperature in the illumination region Z to be adjusted to such a minute degree that it can not be adjusted only by a combination of commercially available LED chips 11. Further, it is possible to use a filter coloring any region in a plurality of different colors as needed.

Figure 7:
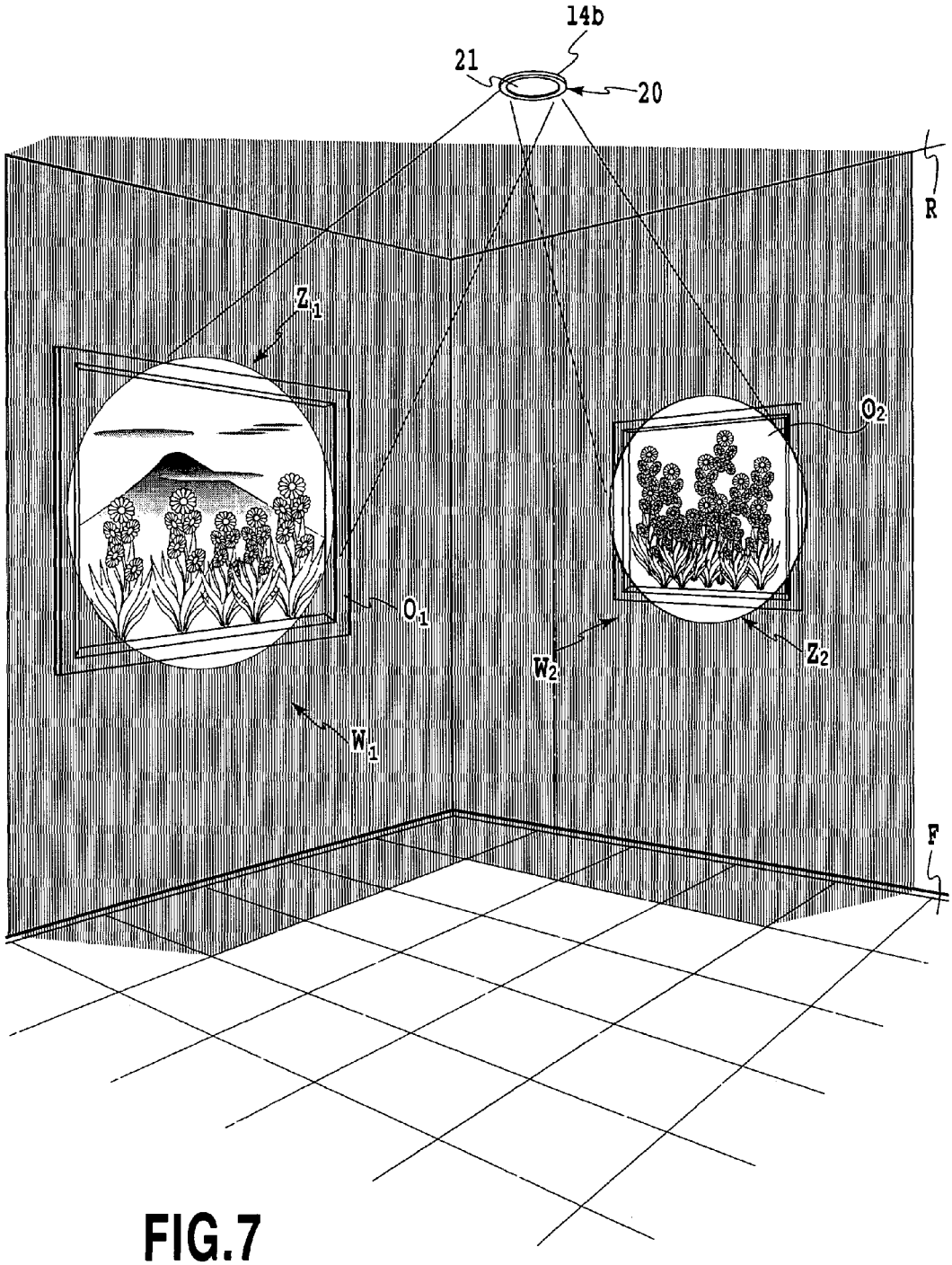
FIG. 7 is three-dimensional projected view showing another embodiment where a lighting system of the present invention is applied to a down spot lighting.
Figure 8:
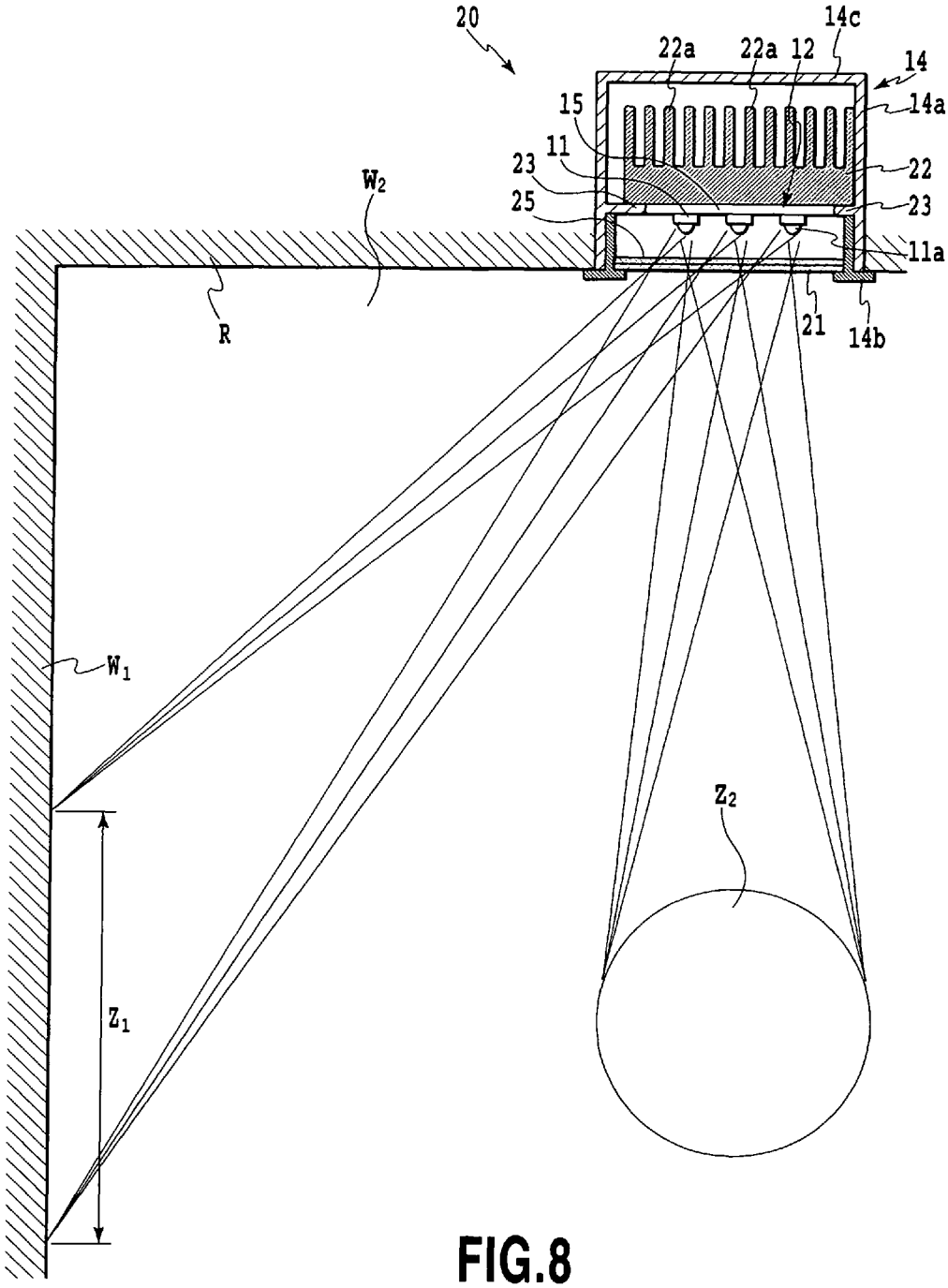
FIG. 8 is a cross-sectional view of the embodiment shown in FIG. 7.

Two or more illumination regions Z may be set. FIG. 7 shows an appearance of another embodiment in which such lighting system having two or more illumination regions Z is applied to a down spot lighting for wall face illumination; and FIG. 8 shows a cross-sectional structure thereof. Like reference numerals are assigned to like functional elements in the preceding embodiments. A duplicate explanation is omitted here. The down spot lighting 20 in this embodiment are mainly comprised of: an LED module 12 into which a plurality of LED chips 11 are incorporated; a hologram 21 disposed in front of the LED module 12; and a cylindrical housing 14 for accommodating the LED module 12 and hologram 21 in their positioned state. This embodiment is identical to the preceding embodiment shown in FIG. 6 in the above point of view. However, the hologram 21 in this embodiment has a function of irradiating the light from the LED module 12 toward objects $O_1$ and $O_2$ respectively fixed to wall faces $W_1$ and $W_2$ orthogonal to each other. In place of such hologram 21, the light from the LED chips 11 may be diverged into a plurality of illumination regions $Z_1$ and $Z_2$ with concurrent use of a beam splitter such as a prism and a deflection lens array.

The above-mentioned embodiment describes the reading lamp 10 incorporated into the writing desk D and the down spot light 20 mounted into the ceiling R of the building. However, the present invention is not limited to such a lighting system, but may be used as a general lighting system in place of a conventional incandescent lamp or fluorescent lamp. For example, the present invention may be applied to an arm light mounted to a tip of a movable arm having a plurality of joints. Or by using an advantage of high luminance, the present invention may be used as a stage lighting system, an outdoor type spot light mounted on the ground for illuminating a wall portion of the building out of doors or the like. Besides, by using an advantage of the LED that is long lifetime, the present invention may be used as a lighting system required to be used in a difficult place in exchange or maintenance, for example, as a foot lamp incorporated into a bed in a hotel.

When the present invention is applied to an arm light, it is required that a light deflection optical element can be replaced in accordance with a distance between the illumination region and the semiconductor light emitting device and also a clearance between the semiconductor light emitting device and the light deflection optical element can be changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A lighting system comprising:

a wiring substrate in which a connecting portion to a power source is formed;

a plurality of condenser lenses;

a plurality of LEDs, each LED being integrally connected to a separate one of the condenser lenses and mounted in a predetermined array pattern on the wiring substrate;

a plurality of deflection lenses disposed in proximity to the LEDs between the LED and a predetermined spatial region to lead lights emitted from the LEDs to the predetermined spatial region in a state where the lights are superposed with each other, the deflection lenses being set in a reduced array pattern corresponding to the array pattern of the LEDs; and a housing for receiving the lenses and the wiring substrate therein, wherein the optical axes of the condenser lenses of the LEDs are in parallel with each other, an optical axis of each of the deflection lenses being set in parallel to the optical axis of their corresponding condenser lenses, the optical axis of each of the deflection lenses being offset to a central side of the predetermined spatial region from the optical axis of their corresponding condenser lenses.

2. A lighting system as claimed in claim 1, wherein at least two kinds of the LEDs having different color rendering properties are mounted on the wiring substrate in such a manner as to be mixed in a predetermined ratio.

3. A lighting system as claimed in claim 2, further comprising a filter through which the light emitted from at least one of the LEDs passes.

4. A lighting system as claimed in claim 1, further comprising a filter through which the light emitted from at least one of the LEDs passes.

5. A lighting system as claimed in claim 1, wherein the deflection lenses are piano-convex lenses corresponding to their respective LEDs, the plano-convex lens has a flat optical surface facing toward the LED and a convex optical surface facing toward the predetermined spatial region, and all the flat optical surfaces of the individual piano-convex lenses are on a common plane which is perpendicular to the optical axis of the condenser lenses.

6. A lighting system as claimed in claim 5, wherein the plurality of the piano-convex lenses are integrally molded in an array.

7. A lighting system as claimed in claim 1, wherein the offset direction of each of the optical axis of the deflection lenses is set to be symmetric to a center of the array pattern of the LEDs.

8. A lighting system as claimed in claim 7, wherein an offset amount of each of the deflection lenses is set based upon a relative position between their corresponding LED and the predetermined region.

9. A lighting system as claimed in claim 1, wherein an offset amount of each of the deflection lenses is set based upon a relative position between their corresponding LED and the predetermined region.

10. A lighting system comprising:

a wiring substrate in which a connecting portion to a power source is formed;

a plurality of LEDs;

a plurality of deflection lenses;

a plurality of condenser lenses disposed between the plurality of LEDs and the plurality of deflection lenses, wherein each LED is integrally connected to a separate one of the condenser lenses and mounted in a predetermined array pattern on the wiring substrate, and wherein the deflection lenses are disposed in proximity to the LEDs between the LED and a predetermined spatial region to lead lights emitted from the LEDs to the predetermined spatial region in a state where the lights are superposed with each other, the deflection lenses being set in a reduced array pattern corresponding to the array pattern of the LEDs; and a housing for receiving the lenses and the wiring substrate therein, wherein the optical axes of the condenser lenses of the LEDs are in parallel with each other, an optical axis of each of the deflection lenses being set in parallel to the optical axis of their corresponding condenser lenses, the optical axis of each of the deflection lenses being offset to a central side of the predetermined spatial region from the optical axis of their corresponding condenser lenses.

* * * * *